US010323630B2

(12) United States Patent
Kang et al.

(10) Patent No.: US 10,323,630 B2
(45) Date of Patent: Jun. 18, 2019

(54) LINEAR COMPRESSOR

(71) Applicant: LG ELECTRONICS INC., Seoul (KR)

(72) Inventors: Donghan Kang, Seoul (KR); Junghae Kim, Seoul (KR); Changkyu Kim, Seoul (KR); Hyunsoo Kim, Seoul (KR); Hyosang Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 15/496,077

(22) Filed: Apr. 25, 2017

(65) Prior Publication Data

US 2017/0321682 A1 Nov. 9, 2017

(30) Foreign Application Priority Data

May 3, 2016 (KR) ..... 10-2016-0054878

(51) Int. Cl.

*F04B 39/12* (2006.01)
*F04B 35/04* (2006.01)
*F04B 39/00* (2006.01)

(52) U.S. Cl.

CPC ..... *F04B 39/123* (2013.01); *F04B 35/045* (2013.01); *F04B 39/0055* (2013.01); *F04B 39/0072* (2013.01); *F04B 39/121* (2013.01)

(58) Field of Classification Search

CPC ..... F04B 35/045; F04B 39/0055; F04B 39/0072; F04B 39/121; F04B 39/123; F16L 21/08

See application file for complete search history.

(56) References Cited

U.S. PATENT DOCUMENTS 5,794,989 A * 8/1998 Ryu ..... F16L 21/08 285/345
6,186,558 B1 2/2001 Komolrochanaporn
(Continued)

FOREIGN PATENT DOCUMENTS

CN 1169907 1/1998
CN 1280267 1/2001
(Continued)

OTHER PUBLICATIONS

European Search Report dated Sep. 25, 2017 issued in Application No. 17167092.0.

(Continued)

*Primary Examiner* — Thomas E Lazo
(74) *Attorney, Agent, or Firm* — KED & Associates LLP

(57) ABSTRACT

A linear compressor is provided that may include a shell; a compressor body accommodated in the shell to compress a refrigerant; a discharge cover assembly through which the refrigerant compressed in the compressor body may be discharged; a cover pipe that extends from the discharge cover assembly to discharge the refrigerant discharged into the discharge cover assembly to an outside of the discharge cover assembly; a discharge pipe coupled to the shell to discharge the refrigerant flowing along the cover pipe to an outside of the shell; a loop pipe having a first end connected to the cover pipe and a second end connected to the discharge pipe; and a coupling member that respectively couples both the first and second ends of the loop pipe to the cover pipe and the discharge pipe. The coupling member may include a connection member, a first portion of which is inserted into the loop pipe and a second portion of which is inserted into the discharge pipe or the cover pipe. The connection member may be formed of a steel material. At (Continued)

least one of the discharge pipe or the cover pipe may be formed of a steel material.

18 Claims, 8 Drawing Sheets

(56) References Cited

U.S. PATENT DOCUMENTS

| | | | | |
|---|---|---|---|---|
| 8,678,794 | B2 * | 3/2014 | Iversen | F04B 39/123 417/312 |
| 2005/0106037 | A1 | 5/2005 | Kim et al. | |
| 2014/0232107 | A1 | 8/2014 | Raasch | |
| 2015/0219086 | A1 * | 8/2015 | Puff | F04B 39/0055 417/312 |
| 2016/0121422 | A1 * | 5/2016 | Si | B23K 35/0261 219/74 |

FOREIGN PATENT DOCUMENTS

| | | |
|---|---|---|
| CN | 2463648 | 12/2001 |
| CN | 203052081 | 7/2013 |
| EP | 3 026 266 | 6/2016 |
| GB | 661271 | 11/1951 |
| KR | 10-2016-0005516 | 1/2016 |
| WO | WO 2014/026262 | 2/2014 |

OTHER PUBLICATIONS

Chinese Office Action dated Aug. 2, 2018, issued in Application No. 201710263351.5 (English translation attached).

* cited by examiner

LINEAR COMPRESSOR

CROSS-REFERENCE TO RELATED APPLICATION(S)

The present application claims the benefits of priority to Korean Patent Application No. 10-2016-0054878, filed in Korea on May 3, 2016, which is herein incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. The cooling system includes a compressor, a condenser, an expansion device, and an evaporator. Also, the cooling system may be installed or provided in a home appliance including a refrigerator or an air conditioner.

In general, compressors are machines that receive power from a power generation device, such as an electric motor or a turbine, to compress air, a refrigerant, or various gaseous working fluids, thereby increasing a pressure and a temperature. The compressors are being widely used in home appliances or industrial fields.

Such a compressor is largely classified into a reciprocating compressor, a scroll compressor, and a rotary compressor. In recent years, development of a linear compressor belonging to one kind of reciprocating compressor has been actively carried out. The linear compressor may be directly connected to a drive motor, in which a piston is linearly reciprocated, to improve compression efficiency without mechanical loss due to movement conversion and have a simple structure.

In general, the linear compressor suctions a gaseous refrigerant while a piston is moved to linearly reciprocate within a cylinder by a linear motor and then compresses the suctioned refrigerant at a high-temperature and a high-pressure to discharge the compressed refrigerant.

A linear compressor is disclosed in Korean Patent Publication No. 10-2016-0005516 (hereinafter referred to as "prior art document"), published Jan. 1, 2016, which is hereby incorporated by reference. The linear compressor includes a shell, a linear motor provided in the shell to generate drive power, a piston driven by the linear motor, a cylinder in which the piston is accommodated, and a discharge cover that defines a discharge space for a refrigerant compressed while the piston reciprocates. The linear compressor may further include a discharge part provided in the shell and a loop pipe connecting the discharge part to the discharge cover.

According to the prior art document, as coupling between the loop pipe and the discharge cover or between the loop pipe and the discharge part is not firm, movement of the loop pipe may occur due to a pressure of the discharged refrigerant. In addition, the coupling between the loop pipe and the discharge cover or between the loop pipe and the discharge part may be released to cause leakage of the refrigerant.

BRIEF DESCRIPTION OF THE DRAWINGS

Embodiments will be described in detail with reference to the following drawings in which like reference numerals refer to like elements, and wherein.

DETAILED DESCRIPTION

Figure 1:
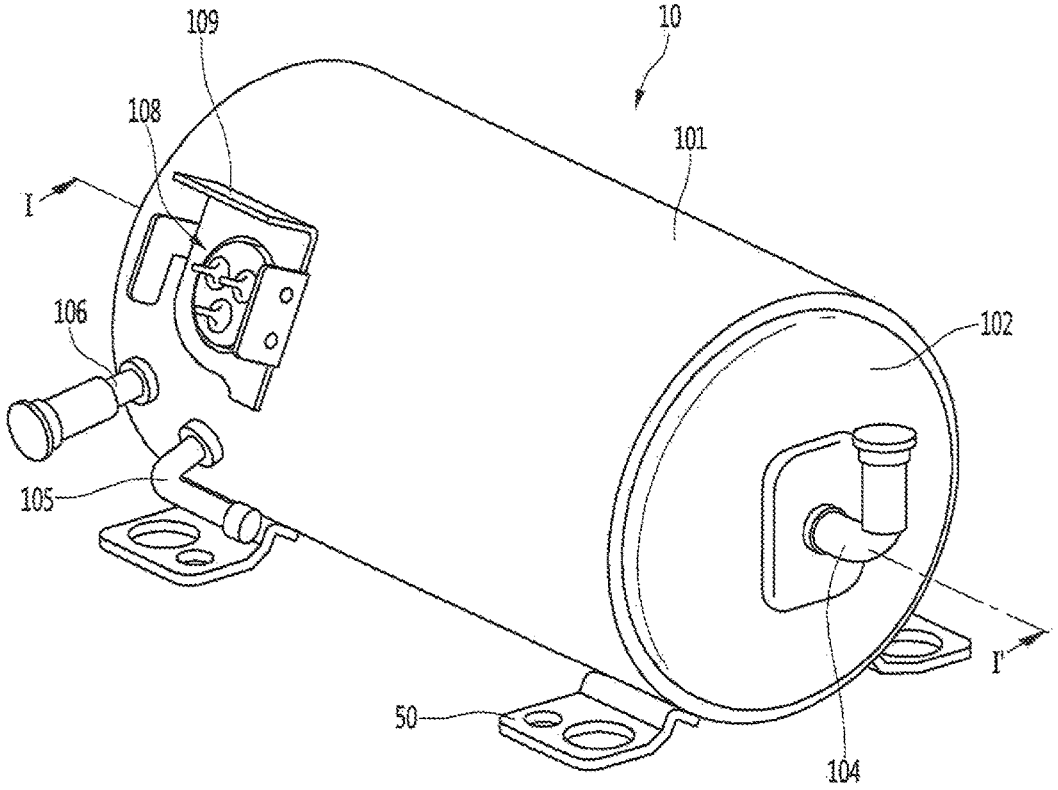
FIG. 1 is a perspective view illustrating an outer appearance of a linear compressor according to an embodiment.

Hereinafter, embodiments will be described in detail with reference to the accompanying drawings. Where possible, like reference numerals have been used to indicate like elements, and repetitive disclosure has been omitted.

Figure 2:
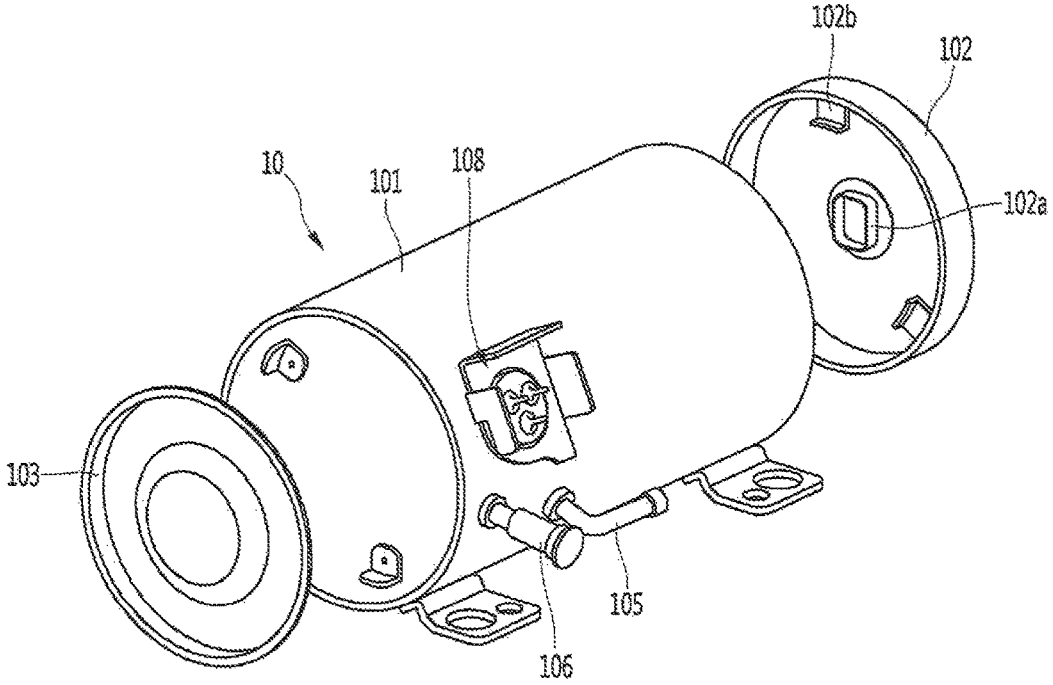
FIG. 2 is an exploded perspective view illustrating a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may transmit external power to a motor (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in the axial direction.

The discharge pipe 105 may be connected to the shell 101. The refrigerant suctioned through the suction pipe 104 may be compressed in a compression space, which will be described hereinafter, while flowing in the axial direction. Also, the compressed refrigerant may be discharged through the discharge pipe 105 to the outside of the compressor 10. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

A first stopper 102*b* may be disposed or provided on the inner surface of the first shell cover 102. The first stopper 102*b* may prevent the compressor body 100, particularly, the motor 140 from being damaged by vibration or an impact, which occurs when the linear compressor 10 is carried.

The first stopper 102*b* may be disposed adjacent to a back cover 170, which will be described hereinafter. When the linear compressor 10 is shaken, the back cover 170 may come into contact with the first stopper 102*b* to prevent the motor 140 from directly colliding with the shell 101.

Figure 3:
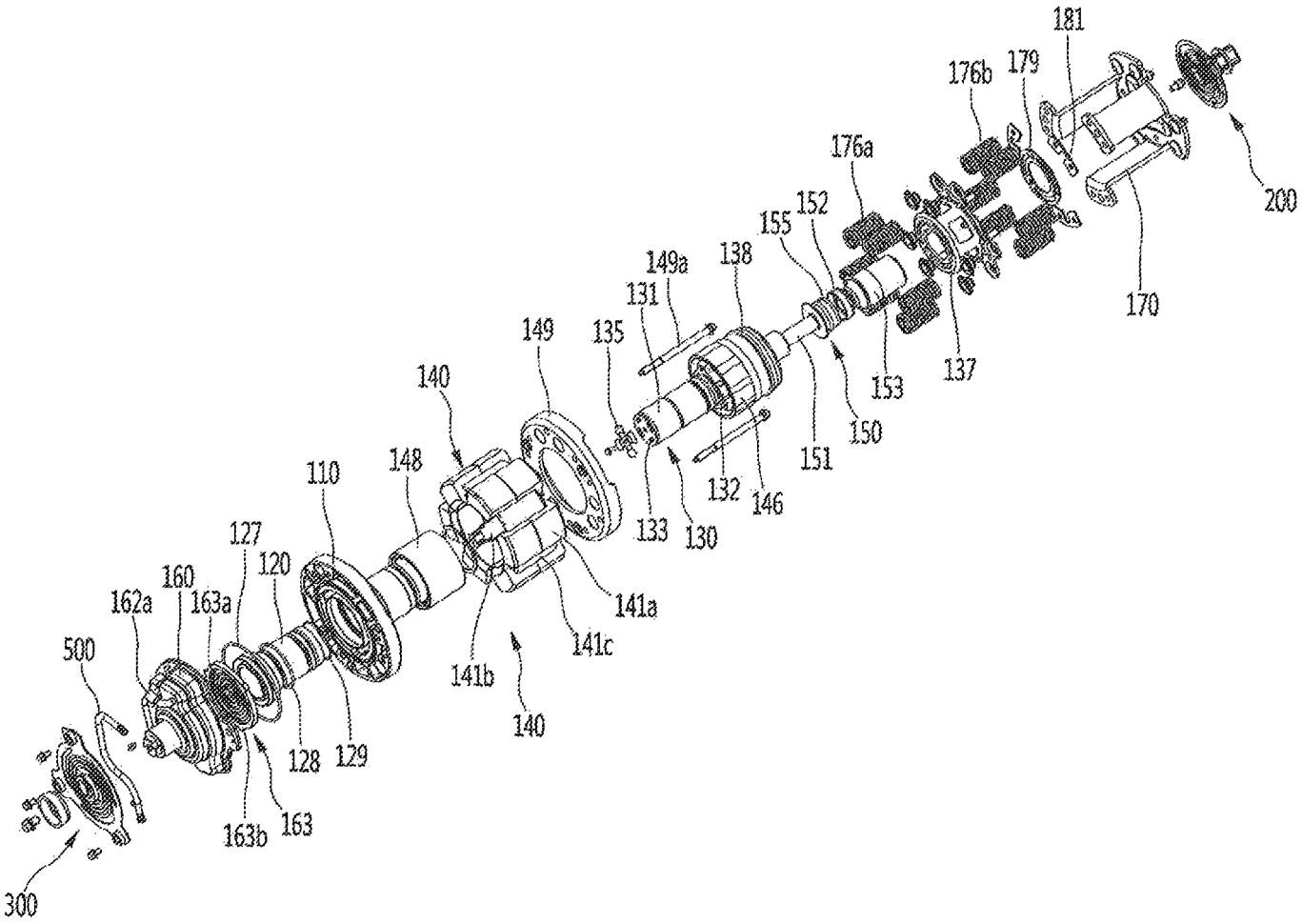
FIG. 3 is an exploded perspective view illustrating internal parts or components of the linear compressor according to an embodiment.
Figure 4:
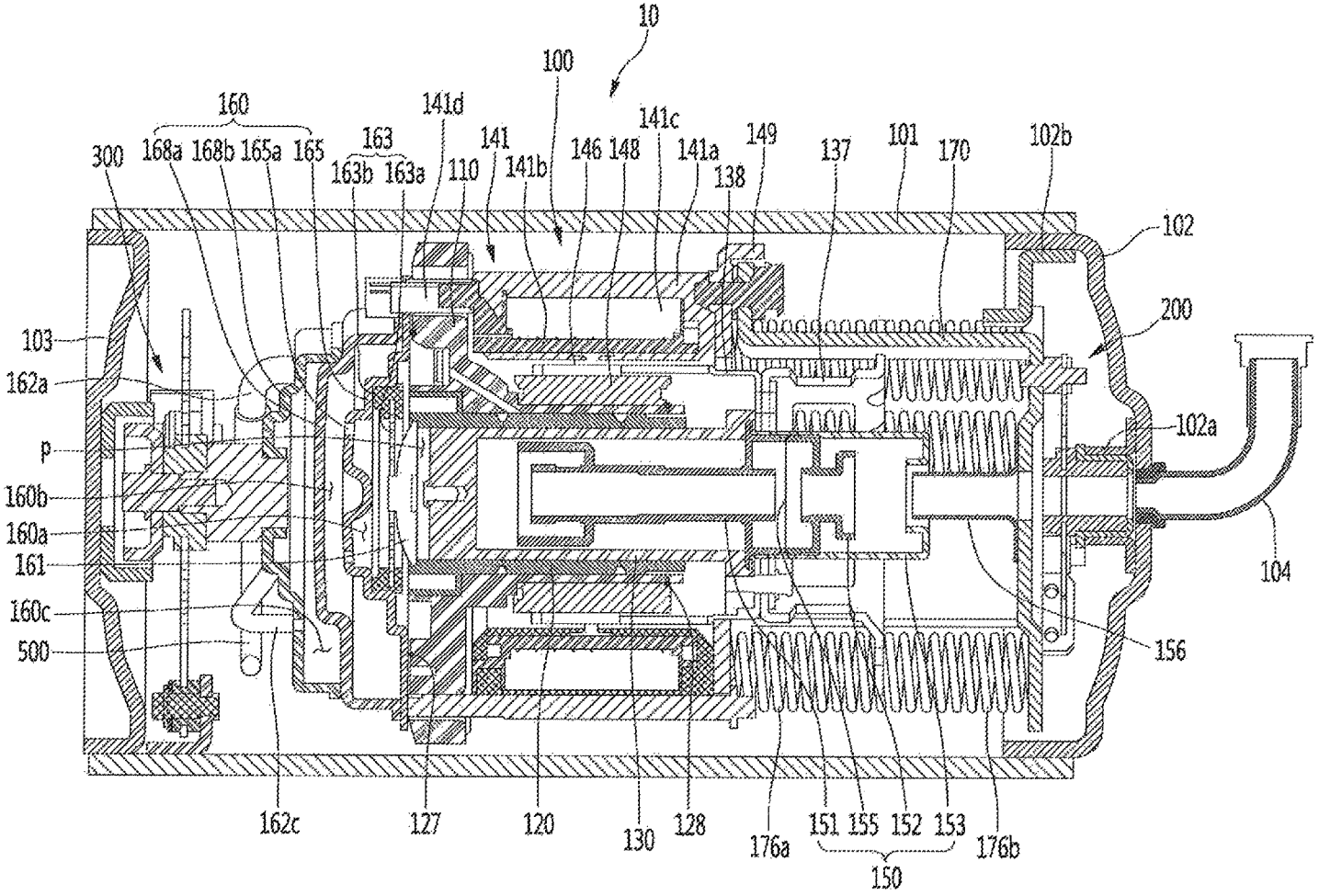
FIG. 4 is a cross-sectional view, taken along line I-I' of FIG. 1.

FIG. 3 is an exploded perspective view illustrating internal parts or components of the linear compressor according to an embodiment. FIG. 4 is a cross-sectional view, taken along line I-I' of FIG. 1.

Referring to FIGS. 3 and 4, the linear compressor 10 according to an embodiment may include the shell 101, a compressor body 100 accommodated in the shell 101, and a plurality of support devices or supports 200 and 300 that supports the compressor body 100. One of the plurality of support devices 200 and 300 may be fixed to the shell 101, and the other one may be fixed to a pair of covers 102 and 103. As a result, the compressor body 100 may be supported to be spaced apart from the inner circumferential surface of the shell 101.

The compressor body 100 may include a cylinder 120 provided in the shell 101, a piston 130 that linearly reciprocates within the cylinder 120, and a motor 140 that applies a drive force to the piston 130. When the motor 140 is driven, the piston 130 may reciprocate in the axial direction.

The compressor body 100 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4. The "axis of the compressor body" may represent a central line or central longitudinal axis in the axial direction of the piston 130.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 that defines a plurality of discharge spaces for the refrigerant discharged from the compression space P and a discharge valve assembly 161 and 163 coupled to the discharge cover assembly 160 to selectively discharge the refrigerant compressed in the compression space P may be provided at a front side of the compression space P. The discharge cover assembly 160 may include a discharge cover 165 coupled to a front surface of the cylinder 120 to accommodate the discharge valve assembly 161 and 163 therein and a plurality of discharge mufflers coupled to a front surface of the discharge cover 165. The plurality of discharge mufflers may include a first discharge muffler 168*a* coupled to the front surface of the discharge cover 165 and a second discharge muffler 168*b* coupled to a front surface of the first discharge muffler 168*a*; however, the number of discharge mufflers are not limited thereto.

The plurality of discharge spaces may include a first discharge space 160*a* defined inside of the discharge cover 165, a second discharge space 160*b* defined between the discharge cover 165 and the first discharge muffler 168*a*, and a third discharge space 160*c* defined between the first discharge muffler 168*a* and the second discharge muffler 168*b*. The discharge valve assembly 161 and 163 may be accommodated in the first discharge space 160*a*.

One or a plurality of discharge holes 165*a* may be defined in the discharge cover 165, and the refrigerant discharged into the first discharge space 160*a* may be discharged into the second discharge space 160*b* through the discharge hole 165*a* and thus is reduced in discharge noise.

The discharge valve assembly 161 and 163 may include a discharge valve 161, which may be opened when a pressure of the compression space P is above a discharge pressure to introduce the refrigerant into the discharge space of the discharge cover assembly 160 and a spring assembly 163 fixed to the inside of the discharge cover 165 to provide elastic force in the axial direction to the discharge valve 161. The spring assembly 163 may include a valve spring 163*a* that applies elastic force to the discharge valve 161 and a spring support part or support 163*b* that supports the valve spring 163*a* to the discharge cover 165.

For example, the valve spring 163*a* may include a plate spring. Also, the spring support part 163*b* may be integrally injection-molded to the valve spring 163*a* through an insertion-molding process.

The discharge valve 161 may be coupled to the valve spring 163*a*, and a rear portion or a rear surface of the discharge valve 161 may be disposed to be supported on the front surface of the cylinder 120. When the discharge valve 161 is closely attached to the front surface of the cylinder 120, the compression space P may be maintained in a sealed state. When the discharge valve 161 is spaced apart from the front surface of the cylinder 120, the compression space P may be opened to discharge the refrigerant compressed in the compression space P to the first discharge space 160*a*.

The compression space P may be a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when a pressure of the compression space P is less than a pressure inside of the suction muffler 150, the suction valve 135 may be opened, and the refrigerant introduced into the suction muffler 150 suctioned into the compression space P. Also, when the refrigerant increases in flow rate, and thus, the pressure of the compression space P is greater than the pressure inside of the suction muffler 150, the suction valve 135 may be closed to become a state in which the refrigerant is compressible.

When the pressure of the compression space P is greater than the pressure of the first discharge space 106*a*, the valve spring 163*a* may be elastically deformed forward to allow the discharge valve 161 to be spaced apart from the front surface of the cylinder 120. Also, when the discharge valve 161 is opened, the refrigerant may be discharged from the compression space P to the first discharge space 160*a*. When the pressure of the compression space P is less than the pressure of the first discharge space 160*a* by the discharge of the refrigerant, the valve spring 163*a* may provide a restoring force to the discharge valve 161 to allow the discharge valve 161 to be closed.

The compressor body 100 may further include a connection pipe 162*c* that connects the second discharge space 160*b* to the third discharge space 160*c*, a cover pipe 162*a* connected to the second discharge muffler 168*b*, and a loop pipe 500 that connects the cover pipe 162*a* to the discharge pipe 105. The connection pipe 162*c* may have one or a first end that passes through the first discharge muffler 168*a* and inserted into the second discharge space 160*b* and the other or a second end connected to the second discharge muffler 158*b* to communicate with the third discharge space 160*c*. Thus, the refrigerant discharged to the second discharge space 160*b* may be further reduced in noise while moving to the third discharge space 160*c* along the connection pipe 162*c*. Each of the pipes 162*a*, 500, and 162*c* may be made of a metal material.

The loop pipe 500 may have one or a first side or end coupled to the cover pipe 162*a* and the other or a second side or end coupled to the discharge pipe 105. The loop pipe 500 may be made of a flexible material. Also, the loop pipe 500 may roundly extend from the cover pipe 162*a* along the inner circumferential surface of the shell 101 and be coupled to the discharge pipe 105. For example, the loop pipe 500 may be provided in a wound shape. While the refrigerant flows along the loop pipe 500, noise may be further reduced.

When the loop pipe 500 is disposed in the wound shape, a phenomenon in which force applied in a direction in which the loop pipe 500 is separated from the cover pipe 162*a* is transmitted to the loop pipe 500 may be prevented or minimized.

A coupling structure between the loop pipe 500 and the cover pipe 162*a* and a coupling structure between the loop pipe 500 and the discharge pipe 105 will be described hereinafter with reference to the accompanying drawings.

The compressor body 100 may further include a frame 110. The frame 110 may be a part that fixes the cylinder 120. For example, the cylinder 120 may be press-fitted into the frame 110.

The frame 110 may be disposed or provided to surround the cylinder 120. That is, the cylinder 120 may be inserted into an accommodation groove defined in the frame 110. Also, the discharge cover assembly 160 may be coupled to a front surface of the frame 110 by using a coupling member.

The compressor body 100 may further include the motor 140. The motor 140 may include an outer stator 141 fixed to the frame 110 to surround the cylinder 120, an inner stator 148 disposed or provided to be spaced inward from the outer stator 141, and a permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The permanent magnet 146 may be disposed or provided on the magnet frame 138. The magnet frame 138 may have an approximately cylindrical shape and be disposed or provided to be inserted into the space between the outer stator 141 and the inner stator 148.

Referring to the cross-sectional view of FIG. 4, the magnet frame 138 may be bent forward after extending from the outer circumferential surface of the piston flange part or flange 132 in the radial direction. The permanent magnet 146 may be fixed to a front end of the magnet frame 138. Thus, when the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed on one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

The inner stator 148 may be fixed to an outer circumference of the frame 110. Also, in the inner stator 148, the plurality of laminations may be laminated outside of the frame 110 in the circumferential direction.

The compressor body 100 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body 100.

The compressor body 100 may further include a back cover 170 coupled to the stator cover 149 to extend backward. The back cover 170 may include three support legs, however, embodiments are not limited thereto, and the three support legs may be coupled to a rear surface of the stator cover 149. A spacer 181 may be disposed or provided between the three support legs and the rear surface of the stator cover 149. A distance from the stator cover 149 to a rear end of the back cover 170 may be determined by adjusting a thickness of the spacer 181. The back cover 170 may be spring-supported by the support 137.

The compressor body 100 may further include an inflow guide part or guide 156 coupled to the back cover 170 to guide an inflow of the refrigerant into the muffler 150. At least a portion of the inflow guide part 156 may be inserted into the suction muffler 150.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 that reciprocates within the linear compressor 10 may be stably moved by the action of the plurality of resonant springs 176*a* and 176*b* to reduce vibration or noise due to the movement of the piston 130.

The compressor body 100 may further include a plurality of sealing members or seals 127 and 128 that increases a coupling force between the frame 110 and the peripheral parts or portions around the frame 110. The plurality of sealing members 127 and 128 may include a first sealing member or seal 127 disposed or provided at a portion at which the frame 110 and the discharge cover 165 are coupled to each other. The plurality of sealing members 127 and 128 may further include a second sealing member or seal 128 disposed or provided at a portion at which the frame 110 and the cylinder 120 are coupled to each other. Each of the first and second sealing members 127 and 128 may have a ring shape.

The plurality of support devices 200 and 300 may include a first support device or support 200 coupled to one or a first side of the compressor body 100 and a second support device or support 300 coupled to the other or a second side of the compressor body 100. The first support device 200 may be fixed to the first shell cover 102, and the second support device 300 may be fixed to the shell 101.

Figure 5:
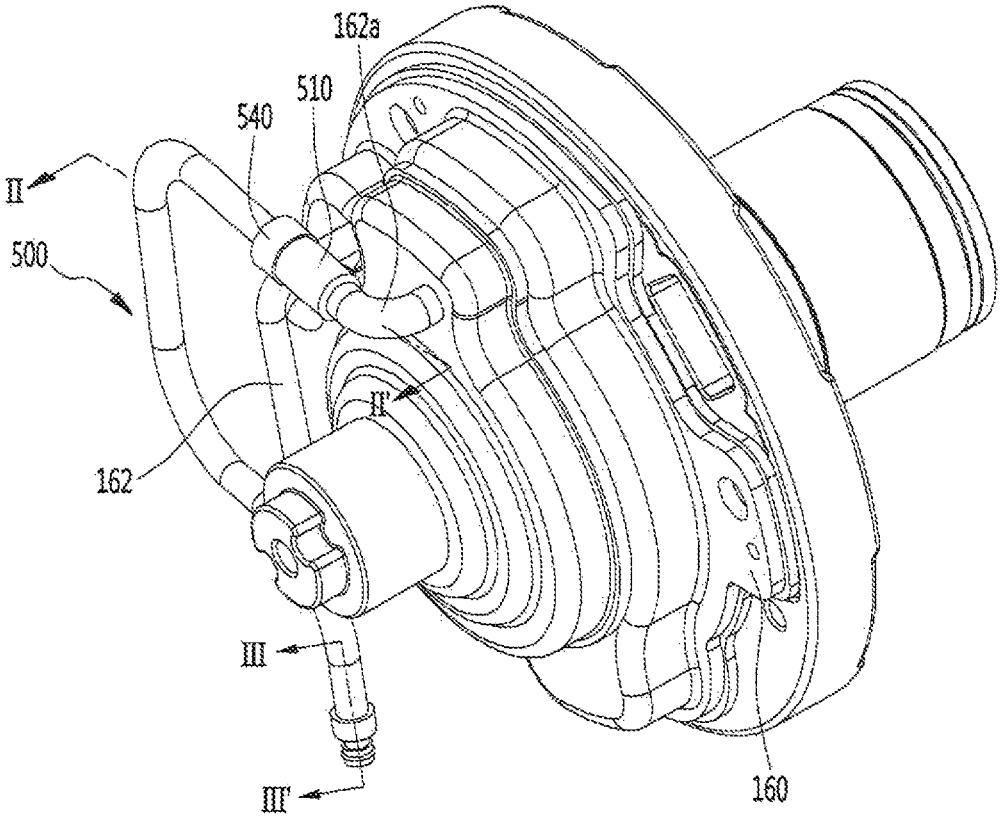
FIG. 5 is a perspective view illustrating a state in which a loop pipe is coupled to a cover pipe.
Figure 6:
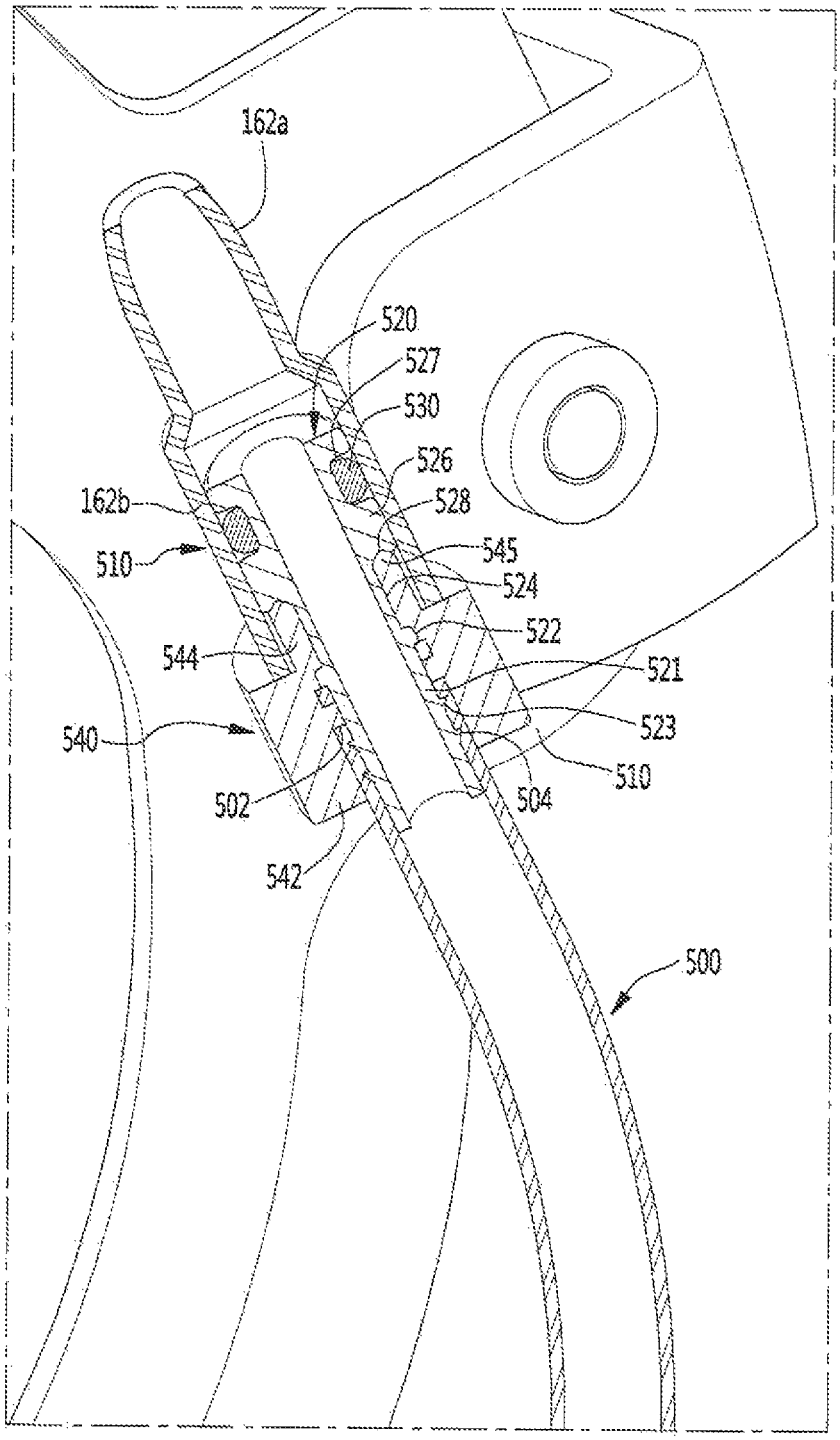
FIG. 6 is a cross-sectional view, taken along line II-III' of FIG. 5.
Figure 7:
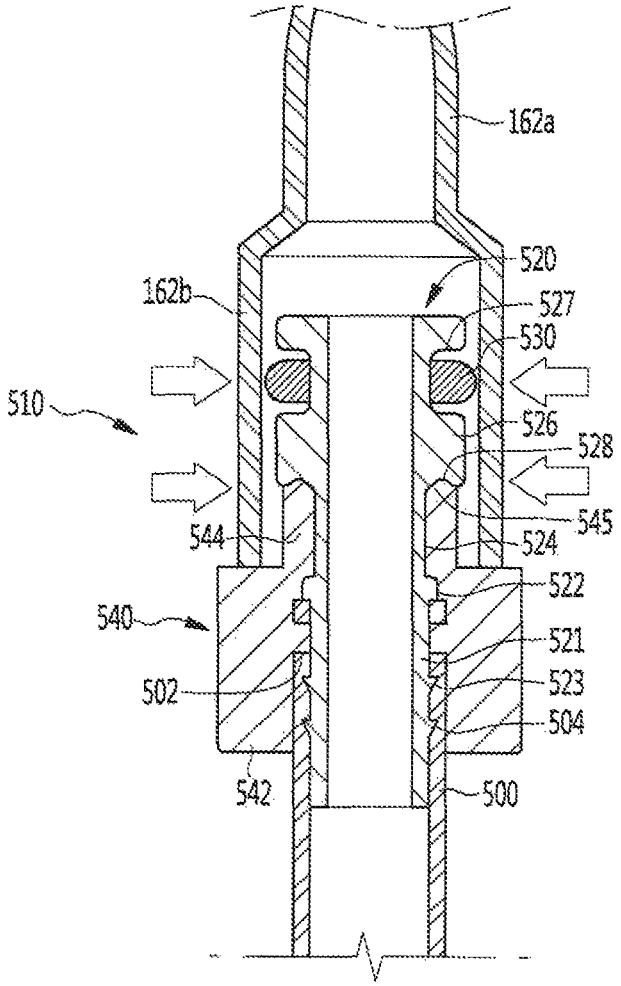
FIG. 7 is a view illustrating a state just before a first coupling part or portion of the loop pipe is coupled to the cover pipe.
Figure 8:
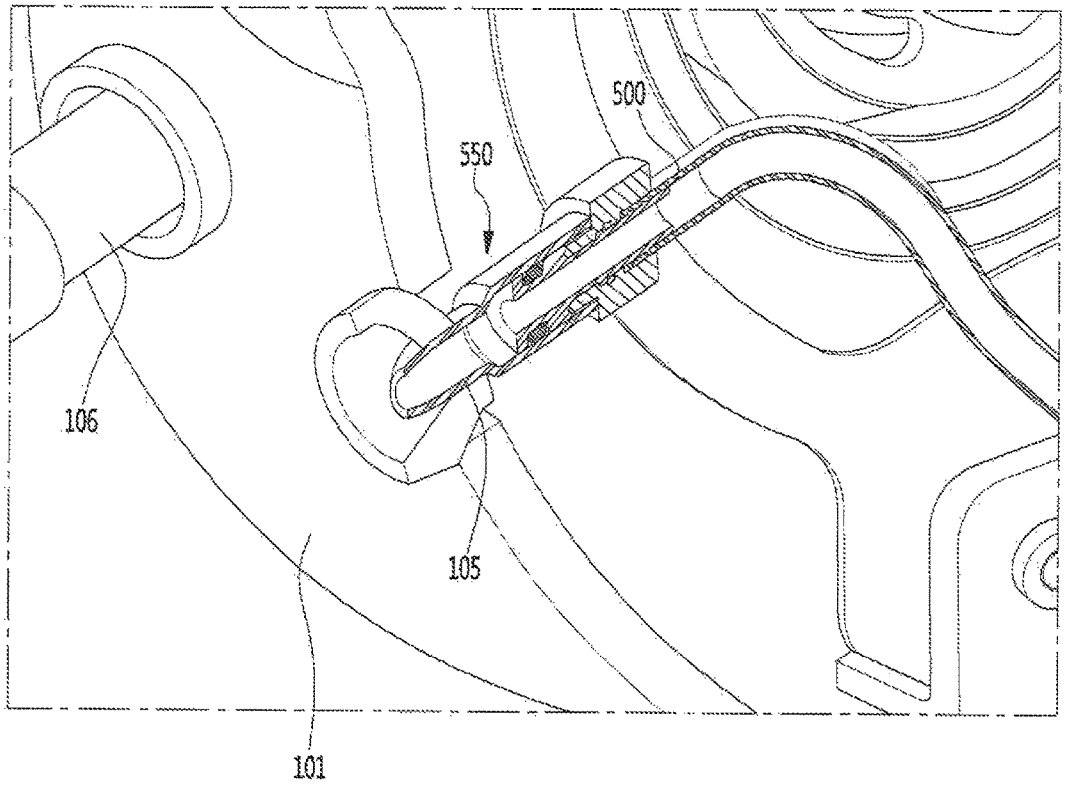
FIG. 8 is a cross-sectional view, taken along line III-III' of FIG. 5 in a state in which a second coupling part or portion of the loop pipe is coupled to a discharge pipe.

FIG. 5 is a perspective view illustrating a state in which the loop pipe is coupled to the cover pipe. FIG. 6 is a cross-sectional view, taken along line II-II' of FIG. 5. FIG. 7 is a view illustrating a state just before a first coupling part or portion of the loop pipe is coupled to the cover pipe. FIG. 8 is a cross-sectional view, taken along line III-III' of FIG. 5 in a state in which a second coupling part or portion of the loop pipe is coupled to the discharge pipe.

Referring to FIGS. 5 to 8, the cover pipe 162*a* may extend from a front surface of the second discharge muffler 168*b* disposed or provided at the frontmost position of the discharge cover assembly 160 to allow the refrigerant discharged to the second discharge space 160*b* to be discharged to the outside of the second discharge space 160*b*.

The loop pipe 500 may be connected to the cover pipe 162*a* and the discharge pipe 105 to allow the refrigerant to be discharged to the outside of the compressor 10.

The connection structure of the loop pipe 500 may include a first coupling part or portion 510 that couples one or a first end of the loop pipe 500 to the cover pipe 162*a* and a second coupling part or portion or portion 550 that couples the other or a second end of the loop pipe 500 to the discharge pipe 105. The first coupling part 510 and the second coupling part 550 may be defined as a coupling member.

The second coupling part 550 may have the same structure as the first coupling part 510. Thus, hereinafter, only the structure and coupling method of the first coupling part 510 will be described as an example.

The first coupling part 510 may include a connection member 520 having one or a first end inserted into the loop pipe 500 and the other or a second end inserted into the cover pipe 162*a*. The connection member 520 may include an insertion part or portion 521 inserted into the loop pipe 500. A stopper 522 may protrude from an outer circumferential surface of the insertion part 521, and the stopper 522 may be disposed or provided at a point which is spaced a predetermined distance from an end of the insertion part 521. The stopper 522 may restrict insertion of the insertion part 521 in a state in which the insertion part 521 is inserted by a predetermined length when the insertion part 521 is inserted into the loop pipe 500.

The stopper 522 may protrude from the outer circumferential surface of the insertion part 521. The stopper 522 may be continuously disposed or provided in a circumferential direction of the insertion part 521, or a plurality of stoppers 522 may be disposed or provided to be spaced apart from each other in a circumferential direction of the connection member 520.

A separation prevention protrusion 523 may protrude from the outer circumferential surface of the insertion part 521 to prevent the insertion part 521 from being separated from the loop pipe 500 in the state in which the insertion part 521 is inserted into the loop pipe 500. A protrusion accommodation groove 504 that accommodates the separation prevention protrusion 523 may be defined in an inner circumferential surface of the loop pipe 500. Each of the separation prevention protrusion 523 and the protrusion accommodation groove 504 may be formed in a continuous band shape, like the stopper 522, or a plurality of protrusions and a plurality of accommodation grooves may be disposed or provided to be spaced apart from each other in the circumferential direction. A plurality of the separation prevention protrusion 523 may be provided in a longitudinal direction of the insertion part 521 to effectively prevent the insertion part 521 from being separated from the loop pipe 500.

The first coupling part 510 may further include a pipe cover 540 that surrounds a portion of an outer circumferential surface of the loop pipe 500, in which the connection member 520 is inserted, and a portion of an outer circumferential surface of the connection member 520. The pipe cover 540 may be integrated with the loop pipe 500 by insert injection-molding, for example, in a state in which the insertion part 521 is inserted into the loop pipe 500. Although not limited thereto, each of the loop pipe 500 and the pipe cover 540 may be made of a nylon material.

The pipe cover 540 integrated with the loop pipe 500 by the insert injection-molding may support a portion of the loop pipe 500 as well as a portion of the connection member 520. That is, the pipe cover 540 may include a first cover 542 that covers the loop pipe 500 and a second cover 544 that extends from the first cover 542 to cover the connection member 520.

The first cover 542 may have an outer diameter greater than an outer diameter of the second cover 544. That is, the pipe cover 540 may be stepped. A stepped surface provided on the pipe cover 540 may be configured so that the connection member 520 may be inserted into the cover pipe 162*a* until an end of the cover pipe 162*a* is closely attached to the stepped surface. That is, the stepped surface may limit a length by which the connection member 520 may be inserted into the cover pipe 162*a*.

A hole 502, into which a portion of the pipe cover 540 may be accommodated, may be defined in the loop pipe 500 to prevent the insert-injection-molded pipe cover 540 from being separated from the loop pipe 500. The hole 502 may be defined in or at a point which is spaced apart from an end of the loop pipe 500. That is, a molding solution for molding the pipe cover 540 may be filled into the hole 502 during the insert injection-molding, and then, the pipe cover 540 may not be separated from the loop pipe 500 after the injection molding. Also, a plurality of the hole 502 may be provided, which may be spaced apart from each other in the circumferential direction of the loop pipe 500. In addition, the plurality of holes 502 may be provided in a longitudinal direction of the loop pipe 500.

If the plurality of the hole 502 is provided in the circumferential direction of the loop pipe 500, when a rotational force is applied to the pipe cover 540, a portion corresponding to the molding solution filled into the hole 502 may act as rotational resistance to prevent the pipe cover 540 from rotating with respect to the loop pipe 500.

The cover pipe 162*a* may include a connection member coupling part or portion 162*b* into which the connection member 520 may be inserted. The connection member 520 may further include a coupling part or portion 526 to be coupled to the connection member coupling part 162*b*.

The coupling part 526 may further extend from the end of the insertion part 521 and have an outer diameter greater than an outer diameter of the insertion part 521. The stopper 522 may be disposed or provided at a point which is spaced apart from the coupling part 526. The second cover 544 constituting or forming the pipe cover 540 may have a thickness corresponding to a distance from the outer circumferential surface of the insertion part 521 to an inner circumferential surface of the connection member coupling part 162*b* and surround the connection member 522 between the stopper 522 and the coupling part 526. Also, the first cover 542 of the pipe cover 540 may surround the stopper 522.

As the second cover 544 is disposed or provided between the stopper 522 and the coupling part 526, a phenomenon in which the connection member 520 is separated from the pipe cover 540 may be prevented. The outer circumferential surface of the connection member 520, on which the second cover 544 may be disposed or provided, that is, the outer circumferential surface of the connection member 520, which corresponds between the stopper 522 and the coupling part 526, may be defined as a cover seating part or seat 524. The cover seating part 524 may have an outer diameter equal to or less than the outer diameter of the insertion part 521. As the cover seating part 524 has the outer diameter less than the outer diameter of the insertion part 521, a contact area between the stopper 522 and the second cover 544 in the radial direction and the circumferential direction may increase, and thus, the connection member 520 may be stably fixed to the pipe cover 540.

An accommodation groove 528 that accommodates an end 545 of the pipe cover 540 may be defined in the coupling part 526. The accommodation groove 528 may be recessed by a predetermined depth from a rear surface of the coupling part 526 toward the front surface of the coupling part 526. As the end 545 of the pipe cover 540 is accommodated into the accommodation groove 528 of the coupling part 526, a phenomenon in which an end of the second cover 544 is spread in the radial direction may be prevented.

A sealing member seating groove 527 having a ring shape and recessed by a predetermined depth in the circumferential direction may be defined in the coupling part 526. A sealing member 530 may be fitted into the sealing member seating groove 527. The sealing member 530 may be, for example, an O-ring.

As illustrated in FIG. 7, in the state in which the coupling part 526 is accommodated in the connection member coupling part 162*b*, the connection member coupling part 162 may be reduced in diameter by a caulking process, for example. That is, as the connection member coupling part 162*b* is reduced in diameter by the caulking process, the inner circumferential surface of the connection member coupling part 162*b* may press the sealing member 530. As described above, the inner circumferential surface of the connection member coupling part 162*b* may press the outer circumferential surface of the coupling part 526 in the state of coming into contact with the outer circumferential surface of the coupling part 526 and thus be closely attached and coupled to the outer circumferential surface of the coupling part 526.

The coupling part 526 may have an outer diameter less than an outer diameter of the connection member coupling part 162*b* before the caulking process so that the coupling part 526 may be easily inserted into the connection member coupling part 162*b*. Also, the second cover 544 may have an outer diameter less than the outer diameter of the coupling part 526 to prevent the second cover 544 from interfering with the connection member coupling part 162*b* while the coupling part 526 is inserted into the connection member coupling part 162*b*. Thus, the second cover 544 may be prevented from being damaged while the coupling part 526 and the connection member coupling part 162*b* are coupled to each other.

The connection member 520 may be made of a steel material so that the coupling part 526 and the connection member coupling part 162*b* may be firmly coupled to each other, and the coupling part 526 prevented from being damaged during the caulking process. As each of the connection member 520 and the cover pipe 162*a* may be made of the steel material, a contact surface between the connection member 520 and the cover pipe 162*a* may increase in frictional force after the caulking process is completed, and thus, the connection member 520 may be stably coupled to the cover pipe 162*a* without being easily separated from the cover pipe 162*a*. Further, a phenomenon in which the refrigerant leaks between the connection member 520 and the cover pipe 162*a* may be prevented.

Also, according to an embodiment, as the contact surface between the connection member 520 and the cover pipe 162*a* increase in frictional force, it is sufficient to provide only a single sealing member 530 on the outer circumferential surface of the coupling part 526. Thus, as each of the coupling part 526 and the connection member coupling part 162*b* is capable of being designed to have a short length, a space within the shell 101, which is occupied by the first coupling part 510, may be reduced. Also, as the space within the shell 101, which is occupied by the first coupling part 510, is reduced, an increase in volume of the shell 101 may be minimized.

Hereinafter, a process of coupling the loop pipe 500 to the cover pipe 162*a* by the first coupling part 510 will be described hereinafter.

First, the insertion part 521 constituting or forming a portion of the connection member 520 may be inserted into the loop pipe 500. The insertion part 521 may be inserted into the loop pipe 500 until the stopper 522 comes into contact with an end of the loop pipe 500.

The pipe cover 540 may be molded to surround a portion of the loop pipe 500 and a portion of the connection member 520 through the insert injection molding in the state in which the insertion part 521 is inserted into the loop pipe 500. Then, the sealing member 530 may be coupled to the sealing member seating groove 527 defined in the outer circumferential surface of the coupling part 526.

Next, the coupling part 526 may be inserted into the connection member coupling part 162*b*. The coupling part 526 may be inserted into the connection member coupling part 162*b* until an end of the connection member coupling part 162*b* comes into contact with the stepped surface of the pipe cover 540. Finally, the caulking process through which the connection member coupling part 162*b* may be reduced in diameter may be performed so that the coupling part 526 and the connection member coupling part 162*b* may be firmly attached to each other.

According to the above-described process, the loop pipe 500 may have one end stably coupled to the cover pipe 162*a* and the other end stably coupled to the discharge pipe 105.

According to embodiments disclosed herein, the coupling part that couples the guide pipe to the cover discharge part or the discharge pipe may include the connection member made of the steel material, and the cover discharge part or the discharge pipe may be made of the steel material to prevent the connection member from being damaged while the connection member is coupled to the discharge pipe. When the damage to the connection member is prevented, it may prevent the refrigerant from leaking through the connection portion between the connection member and the cover discharge part or between the connection member and the discharge pipe.

Also, according to embodiments disclosed herein, as the connection member may be made of the steel material, and the cover discharge part or the discharge pipe is made of the steel material, the contact surface between the connection member and the cover discharge part or between the connection member and the discharge pipe may increase in frictional force during the caulking process to effectively prevent the refrigerant from leaking. After the caulking process is completed, as the contact surface between the connection member and the cover discharge part increases in frictional force, one sealing member may be disposed on the circumference of the connection member. Thus, as the connection member is reduced in length, and the cover discharge part is reduced in length, it may prevent the space, in which the connection member and the cover discharge part are disposed, from increasing within the shell, and thus, to prevent the shell from increasing in size.

Also, according to embodiments disclosed herein, as the coupling part may include the connection member connected to the guide pipe and the cover discharge part surrounding the guide pipe and the connection member, and a portion of the cover discharge part may be inserted into the guide pipe, the cover discharge part may be prevented from being separated from the guide pipe and from rotating with respect to the guide pipe. Also, as the connection member may include the stopper that limits a depth by which the connection member may be inserted into the guide pipe and the coupling part to be coupled to the cover discharge part, and a portion of the pipe cover may be disposed or provided between the stopper and the coupling part, the connection member may be prevented from being separated from the pipe cover.

Embodiments disclosed herein provide a linear compressor in which damage to a guide pipe through which a compressed refrigerant flows may be prevented while the guide pipe is connected to a discharge cover and a discharge pipe. Embodiments disclosed herein further provide a linear compressor in which a refrigerant may be prevented from leaking through connection portions between a guide pipe and a discharge cover and between the guide pipe and a discharge pipe.

Embodiments disclosed herein also provide a linear compressor in which a guide pipe may be prevented from being separated from a discharge cover and a discharge pipe after the guide pipe is connected to the discharge cover and the discharge pipe. Embodiments disclosed herein additionally provide a linear compressor in which a number of sealing member or seal used for connection portions between a guide pipe and a discharge cover and between the guide pipe and a discharge pipe may be reduced. Embodiments disclosed herein provide a linear compressor a total length of which may be prevented from increasing due to an increase in length of a cover discharge part connected to a guide pipe.

Embodiments disclosed herein provide a linear compressor that may include a shell; a compressor body accommodated in the shell to compress a refrigerant; a discharge cover assembly through which the refrigerant compressed in the compressor body may be discharged; a cover pipe that extends from the discharge cover assembly to discharge the refrigerant discharged into the discharge cover assembly to an outside of the discharge cover assembly; a discharge pipe coupled to the shell to discharge the refrigerant flowing along the cover pipe to an outside of the shell; a loop pipe having one or a first end connected to the cover pipe and the other or a second end connected to the discharge pipe; and a coupling member that respectively couples both ends of the loop pipe to the cover pipe and the discharge pipe. The coupling member may include a connection member, one or a first portion of which may be inserted into the loop pipe and the other or a second portion of which may be inserted into the discharge pipe or the cover pipe, the connection member being formed of a steel material. At least one of the discharge pipe or the cover pipe may be formed of a steel material.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a compressor body accommodated in the shell to compress a refrigerant;

a discharge cover assembly through which the refrigerant compressed in the compressor body is discharged;

a cover pipe that extends from the discharge cover assembly to discharge the refrigerant discharged into the discharge cover assembly to an outside of the discharge cover assembly;

a discharge pipe coupled to the shell to discharge the refrigerant flowing along the cover pipe to an outside of the shell;

a loop pipe having a first end connected to the cover pipe and a second end connected to the discharge pipe; and a coupling member that respectively couples both the first and second ends of the loop pipe to the cover pipe and the discharge pipe, wherein the coupling member includes:

a connection member, a first portion of which is inserted into the loop pipe and a second portion of which is inserted into the discharge pipe or the cover pipe; and a pipe cover that surrounds the loop pipe and the connection member, wherein the pipe cover includes:

a first cover that surrounds the loop pipe; and a second cover that extends from the first cover to surround the connection member, wherein the second cover has an outer diameter less than an outer diameter of the first cover.

2. The linear compressor according to claim 1, wherein the connection member includes:

an insertion portion inserted into the loop pipe; and one or more stoppers that protrudes from an outer circumferential surface of the connection member to restrict an insertion depth of the insertion portion.

3. The linear compressor according to claim 2, wherein at least one separation prevention protrusion that prevents the insertion portion from being separated from the loop pipe is provided on an outer circumferential surface of the insertion portion, and a protrusion accommodation groove into which the protrusion is accommodated is defined in an inner circumferential surface of the loop pipe.

4. The linear compressor according to claim 2, wherein the connection member further includes a coupling portion inserted into the discharge pipe or the cover pipe, wherein the coupling portion has a diameter greater than an outer diameter of the insertion portion, and wherein the second cover has an outer diameter less than the outer diameter of the coupling portion.

5. The linear compressor according to claim 4, wherein the coupling portion is provided at a point which is spaced apart from the one or more stoppers, and wherein the second cover is provided between the coupling portion and the one or more stoppers.

6. The linear compressor according to claim 5, wherein an accommodation groove that accommodates an end of the second cover is defined in a surface of the coupling portion, which faces the loop pipe.

7. The linear compressor according to claim 4, further including a sealing member provided on an outer circumferential surface of the coupling portion, wherein a sealing member seating groove in which the sealing member is seated is defined in the outer circumferential surface of the coupling portion.

8. The linear compressor according to claim 1, wherein the pipe cover is integrated with the loop pipe and the connection member through insert injection molding, and one or more holes into which a portion of the pipe cover is filled are provided in the loop pipe.

9. The linear compressor according to claim 8, wherein the one or more holes includes a plurality of holes spaced a predetermined distance from each other in one of a circumferential direction or a longitudinal direction of the loop pipe.

10. The linear compressor according to claim 1, wherein the connection member is formed of a steel material, and wherein at least one of the discharge pipe or the cover pipe is formed of a steel material.

11. A linear compressor, comprising:

a shell;

a compressor body accommodated in the shell to compress a refrigerant;

a discharge cover assembly through which the refrigerant compressed in the compressor body is discharged;

a cover pipe that extends from the discharge cover assembly to discharge the refrigerant discharged into the discharge cover assembly to an outside of the discharge cover assembly;

a discharge pipe coupled to the shell to discharge the refrigerant flowing along the cover pipe to an outside of the shell;

a loop pipe having a first end connected to the cover pipe and a second end connected to the discharge pipe; and a plurality of coupling members that couples the first and second ends of the loop pipe to the cover pipe and the discharge pipe, respectively, wherein each of the plurality of coupling members includes a connection member, a first portion of which is inserted into the loop pipe and a second portion of which is inserted into the discharge pipe or the cover pipe, wherein the connection member includes:

an insertion portion inserted into the loop pipe; and one or more stoppers that protrudes from an outer circumferential surface of the connection member to restrict an insertion depth of the insertion portion, wherein the coupling member includes a pipe cover that surrounds the loop pipe and the connection member, and wherein the pipe cover is integrated with the loop pipe and the connection member through insert injection molding, and one or more holes into which a portion of the pipe cover is filled are provided in the loop pipe.

12. The linear compressor according to claim 11, wherein the one or more holes includes a plurality of holes spaced a predetermined distance from each other in one of a circumferential direction or a longitudinal direction of the loop pipe, and wherein the pipe cover includes:

a first cover that surrounds the loop pipe; and a second cover that extends from the first cover to surround the connection member, wherein the second cover has an outer diameter less than an outer diameter of the first cover.

13. The linear compressor according to claim 12, wherein the connection member further includes a coupling portion inserted into the discharge pipe or the cover pipe, wherein the coupling portion has a diameter greater than an outer diameter of the insertion portion, and the second cover has an outer diameter less than the outer diameter of the coupling portion.

14. The linear compressor according to claim 13, wherein the coupling portion is provided at a point which is spaced apart from the one or more stoppers, and the second cover is provided between the coupling portion and the one or more stoppers.

15. The linear compressor according to claim 14, wherein an accommodation groove that accommodates an end of the second cover is defined in a surface of the coupling portion, which faces the loop pipe.

16. The linear compressor according to claim 12, further including a sealing member provided on an outer circumferential surface of the coupling portion, wherein a sealing member seating groove in which the sealing member is seated is defined in the outer circumferential surface of the coupling portion.

17. The linear compressor according to claim 11, wherein the connection member is formed of a steel material, and wherein at least one of the discharge pipe or the cover pipe is formed of a steel material.

18. A linear compressor, comprising:

a shell;

a compressor body accommodated in the shell to compress a refrigerant;

a discharge cover assembly through which the refrigerant compressed in the compressor body is discharged;

a cover pipe that extends from the discharge cover assembly to discharge the refrigerant discharged into the discharge cover assembly to an outside of the discharge cover assembly;

a discharge pipe coupled to the shell to discharge the refrigerant flowing along the cover pipe to an outside of the shell;

a loop pipe having a first end connected to the cover pipe and a second end connected to the discharge pipe; and a plurality of coupling members that couples the first and second ends of the loop pipe to the cover pipe and the discharge pipe, respectively, wherein each of the plurality of coupling members includes a connection member, a first portion of which is inserted into the loop pipe and a second portion of which is inserted into the discharge pipe or the cover pipe, wherein the connection member includes:

an insertion portion inserted into the loop pipe; and one or more stoppers that protrudes from an outer circumferential surface of the connection member to restrict an insertion depth of the insertion portion, wherein at least one separation prevention protrusion that prevents the insertion portion from being separated from the loop pipe is provided on an outer circumferential surface of the insertion portion, and a protrusion accommodation groove into which the protrusion is accommodated is defined in an inner circumferential surface of the loop pipe, wherein the coupling member includes a pipe cover that surrounds the loop pipe and the connection member, and wherein the pipe cover is integrated with the loop pipe and the connection member through insert injection molding, and one or more holes into which a portion of the pipe cover is filled are provided in the loop pipe.

* * * * *